US005364017A

United States Patent [19]

Bennett

[11] Patent Number: 5,364,017

[45] Date of Patent: Nov. 15, 1994

[54] THREE DIMENSIONAL OBJECTS AND METHODS OF MAKING THE SAME

[76] Inventor: Herbert G. Bennett, 195 E. 31st St., Brooklyn, N.Y. 11226

[21] Appl. No.: 371,962

[22] Filed: Jun. 27, 1989

Related U.S. Application Data

[63] Continuation-in-part of Ser. No. 94,055, Sep. 4, 1987, Pat. No. 4,871,080, which is a continuation-in-part of Ser. No. 928,613, Nov. 4, 1986, abandoned, which is a continuation of Ser. No. 704,751, Feb. 25, 1985, abandoned.

[51] Int. Cl.[5] ..... A63H 33/16

[52] U.S. Cl. ..... 229/107; 428/7; 428/8; 428/9; 428/11

[58] Field of Search ..... 220/1 R, DIG. 13, 890; 229/16 R, 18, 107; 428/7, 8, 9, 11

[56] References Cited

U.S. PATENT DOCUMENTS

| | | | |
|---|---|---|---|
| D. 202,920 | 11/1965 | Meusing | D52/2 |
| D. 252,446 | 7/1979 | Traugott | D9/3 |
| D. 272,806 | 2/1984 | Handy et al. | D9/3 |
| 1,834,413 | 12/1931 | Michelin | 229/115 |
| 1,889,985 | 12/1932 | Hays | 229/115 |
| 2,050,894 | 8/1936 | Paige | 229/16 |
| 2,067,998 | 1/1937 | Williamson | 229/16 |
| 3,062,367 | 11/1962 | Holy | 206/45.31 |
| 3,252,567 | | 206 | 46/ |
| 3,363,747 | 1/1968 | Newak | 206/45.14 |
| 3,437,194 | | 206 | 45.31/ |
| 3,610,514 | 10/1971 | Samsing | 229/38 |
| 3,666,607 | 5/1930 | Weissman | 161/44 |
| 3,682,298 | | 206 | 45.31/ |
| 3,799,424 | | 229 | 16 R/ |
| 3,857,481 | 12/1974 | Koltz | 206/45.14 |
| 4,230,729 | 10/1980 | Hoelzel, Jr. | 426/124 |
| 4,492,723 | 1/1985 | Chadwick, II | 428/7 |

FOREIGN PATENT DOCUMENTS 211560 2/1924 United Kingdom .

OTHER PUBLICATIONS

Billings on Form, Billings, 1851, p. 13.

Handbook of Designs and Devices, Hornung, 1946, p. 11.

Paige, Sculptured Folding Boxes, pp. 48–49.

*Primary Examiner*—Steven M. Pollard

*Attorney, Agent, or Firm*—Pennie & Edmonds

[57] ABSTRACT

The invention relates to the creation of three dimensional objects from elements or blanks produced by inscribing inwardly and outwardly extending circles about a plurality of polygons, such as isoceles triangles, rectangles, or trapezoids of four, six or other even numbered sides through each point where the sides of the polygons intersect. To provide the appropriate arc lengths, the inscribed circles have the same diameter as the length of the side of the polygon where the arcs are to be inscribed. The element is bent or folded along each arc to form the three dimensional object. Multiple elements can be joined to form complex elements by superimposing individual elements upon a portion of adjacent elements. The objects thus formed can be held together by forces generated by the folded arcs, although an adhesive may optionally be used. The elements three dimensional objects, and methods of making same also form part of this invention.

10 Claims, 9 Drawing Sheets

THREE DIMENSIONAL OBJECTS AND METHODS OF MAKING THE SAME

CROSS REFERENCE TO RELATED APPLICATIONS

This application is a continuation-in-part of application Ser. No. 07/094,055, filed Sep. 4, 1987, now U.S. Pat. No. 4,871,080, which is a continuation-in-part of application Ser. No. 06/928,613, filed Nov. 4, 1986, abandoned, which is a continuation of application Ser. No. 06/704,751, filed Feb. 25, 1985, abandoned.

TECHNICAL FIELD

The invention generally relates to geometric figures and more particularly to modular elements capable of forming three dimensional objects, as well as to the three dimensional objects themselves.

BACKGROUND ART

The prior art discloses numerous methods for the formation of three dimensional objects which are useful in a variety of applications. Generally, these objects are formed by initially producing a blank or element which is then folded, bent or otherwise manipulated to conform to the shape of a three dimensional object.

The bulk of the prior art in this regard shows elements having substantially straight lines upon which the edges of the three dimensional objects are folded. Furthermore, in order for the element to hold the shape of the object, the sides, faces, or edges must be secured by tabs, an adhesive or by other sealing or joining means.

It is often desirable, however, to produce and utilize objects with curved or arced faces, sides, or edges rather than straight lines. Objects possessing such curved arc portions, in addition to being more aesthetically pleasing, are useful in containing or displaying irregular shaped products or merchandise.

An example of the aesthetically pleasing appearance of such arced sides of a container is found in U.S. Des. Pat. No. 202,920. This patent, however, is limited to a rectangular shaped container having arced portions only along its four sides. It is further limited with respect to making larger or smaller three dimensional objects having a greater or lesser number of faces or sides. Furthermore, this box cannot be simply constructed from an element or blank unless at least one or more faces or sides is glued or adhesively attached to an adjacent face or side to form the final object.

Therefore, none of the prior art discloses three dimensional objects which utilize a number of inwardly curved arcs as edges or sides to form aesthetically pleasing objects. Furthermore, none of the prior art discloses objects which can be formed from elements or blanks wherein the tension created by folding the sides and faces of the element or blank along its edges enables the object to hold the shape desired. Applicant, however, has now discovered a novel, unusual and surprising method for making elements which can accomplish all of the above. The elements, their method of manufacture, and the three dimensional objects generated therefrom are the subject of this application, which is a complete departure from the Euclidian forms presently known and used at this time.

SUMMARY OF THE INVENTION

One embodiment of the invention relates to a method for making elements which are capable of forming three dimensional objects having any desired number of trigonal components. This element is made by inscribing a first set of intersecting circles having the same radius on a flat, flexible material so that they intersect at Points A and B and form a common area therebetween. The width of the common area is equal to the radius of one of the circles. A second set of two intersecting circles, of the same radius as the initial set of circles is then inscribed in a manner such that they each intersect the initial set of circles and each other at a common first point C and a common second point D midway along each arc AB which defines the common area of the initial set of intersecting circles. Next, four additional circles, each having the same radius as the initial set of circles are inscribed in a manner such that an arc of the first circle intersects points A and C, an arc of the second circle intersects points C and B, an arc of the third circle intersects points A and D and an arc of the fourth circle intersects points D and B. These steps may be performed as often as necessary in order to obtain elements of varying sizes. Finally, the inscribed portion of the flat flexible material is separated along arcs AB to remove the common area of the initial pair of intersecting circles so as to form an element having a desired number of trigonal components.

A further aspect of the invention relates to a method for making an element which is capable of forming a three dimensional object containing two trigonal components wherein a first set of intersecting circles having the same radius is inscribed on a flat, flexible material so that they intersect at Points A and B and form a common area therebetween. The width of the common area is equal to the radius of one of the circles. A second set of two intersecting circles, of the same radius as the initial set of circles is then inscribed in a manner such that they each intersect the initial set of circles and each other at a common first point C and a common second point D midway along each arc AB which defines the common area of the initial set of intersecting circles. Next, four additional circles, each having the same radius as the initial set of circles are inscribed in a manner such that an arc of the first circle intersects points A and C, an arc of the second circle intersects points C and B, an arc of the third circle intersects points A and D and an arc of the fourth circle intersects points D and B. Finally, the inscribed portion of the flat flexible material is separated along arcs AB to remove the common area of the initial pair of intersecting circles so as to form an element having two trigonal components. This method may be repeated to form trigonal components adjoining the element which can be formed into three dimensional objects.

In order to prepare elements and three-dimensional objects from those elements, the circles may be inscribed by mechanical means, such as a steel rule die, or by marking means such as a pen, pencil, paint or indelible marking means or any means capable of defining an arc. The flat flexible material upon which the circles are marked may consist of paper, cardboard, plastic or an elastomer, although any flat flexible material may be used.

The novel and unusual elements which are produced by the methods as described above comprise a further embodiment of the invention.

An alternate method for making an element capable of forming a three dimensional object includes at least partially superimposing a first element of the desired number of trigonal components upon a second element. The second element can be substantially identical to, or the same as, the first element, or it can have a different number of trigonal components. An element produced in this manner comprises a further aspect of the invention.

A further embodiment of the invention relates to the creation of three dimensional objects from the elements produced as described above, wherein the element is bent or folded along each arc to form the object. The object can be held together by forces generated by the folded arcs, although in some applications the use of a adhesive may create a more secure bond or closure. The three dimensional objects thus produced are another aspect of the invention.

Certain types of objects, such as a container with at least two trigonal faces and at least three inwardly curved side arc portions, are particularly advantageous. These containers may be constructed of glass, metal, wood, an elastomer, plastic, paper, cardboard or any suitable material.

An alternate method for making an element capable of forming a three-dimensional object comprises inscribing a polygon having sides of equal length on a flat, flexible material; inscribing a set of circles on each side of the polygon in such a manner that the circles pass through the end points of each side of the polygon and each other, each circle having a radius equal in distance to the length of one of the sides of the polygon, and then separating the inscribed portion of the flat, flexible material along the outer arcs of the inscribed circles. The polygon in question may be, for example, an equilateral triangle, a square or an equilateral pentagon.

An alternate embodiment for making an element capable of forming a three-dimensional object consists of at least partially superimposing a first element, derived as described above from a polygon having sides of equal length, upon a second element created in the same manner. An element produced in this manner comprises a further aspect of the invention.

Once the element is formed as described above, an alternative embodiment of the invention is to create three-dimensional objects from these elements by then bending or folding the element along each arc. The objects created in this manner are also an embodiment of the present invention. These objects may be utilized to make containers and such objects may, for example, comprise at least two quadragonal faces with at least four inwardly curved side portions or at least two pentagonal components with at least five inwardly curved side portions. These containers may be constructed of glass, metal, wood, an elastomer, plastic, paper, cardboard or any suitable material.

BRIEF DESCRIPTION OF THE DRAWINGS

A further understanding of the present invention can be had with reference to the attached drawing figures, wherein.

DETAILS OF THE PREFERRED EMBODIMENTS

It can be appreciated by one skilled in the art that the novel three dimensional objects of the present invention can be formed by a variety of methods. First of all, the individual sides and faces of the object can be cut out from a construction material, and then joined together to form the object. The term "construction material" would contemplate paper, cardboard, plastic, metal, wood, rubber, elastomers, or any suitable material. The particular material selected would depend upon the end use for the three dimensional object. For example, when used in the container art, the material could be paper or cardboard for gift boxes, or if used for the transportation of fluids, it must be prepared from a fluid impervious material, i.e. plastic, steel or the like.

Another method for making these objects would be the construction of an element or blank which is then folded, bent or formed to the shape of the desired three dimensional object. In this embodiment, it is preferred to use a flat, flexible material such as paper, cardboard, plastic, etc. An element can be traced or inscribed upon this material and subsequently cut out. The element can then be folded, bent formed, and/or finished to the final shape of the desired three dimensional object.

Another method for forming the three dimensional objects of the invention is to use frames or similar devices to define the curved edges upon which membrane or similar flexible materials can be stretched.

With respect to the method of preparing the elements of this invention, the following drawing figures illustrate the best mode.

Figure 1:
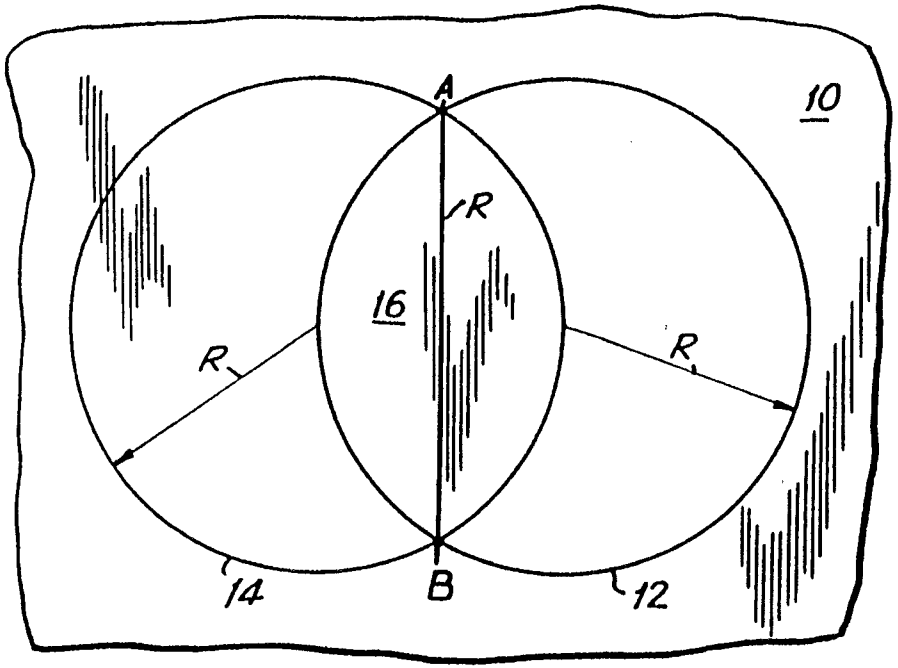
FIG. 1 is an illustration of two intersecting circles.
Figure 14:
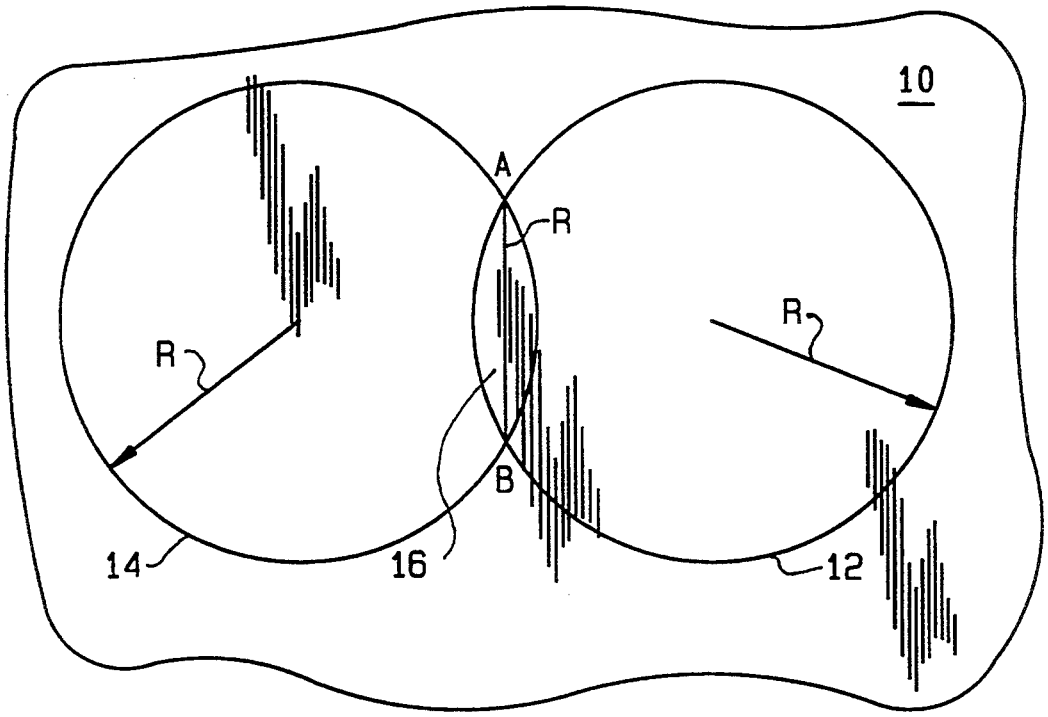
FIG. 14 is a view of two intersecting circles of radius R which has a length equal to the distance along a straight line from point A to point B.

Upon a flat, flexible material such as paper, cardboard or the like, two intersecting circles having the same radius R are inscribed such that they overlap and form a common area. FIG. 1 illustrates a flat, flexible material 10 paper or cardboard which is inscribed with two circles 12, 14 having the same radius. These circles 12, 14, intersect at two points A,B to form a common area 16. Also, as shown in FIG. 14, the width of the common area along a straight line from point A to point B equals the length of the radius of the circles. This common area 16 is defined by two arcs AB from each of the circles 12, 14. The common area 16 forms the outer dimensions of the basic element for the preferred embodiment of the invention.

Figure 2:
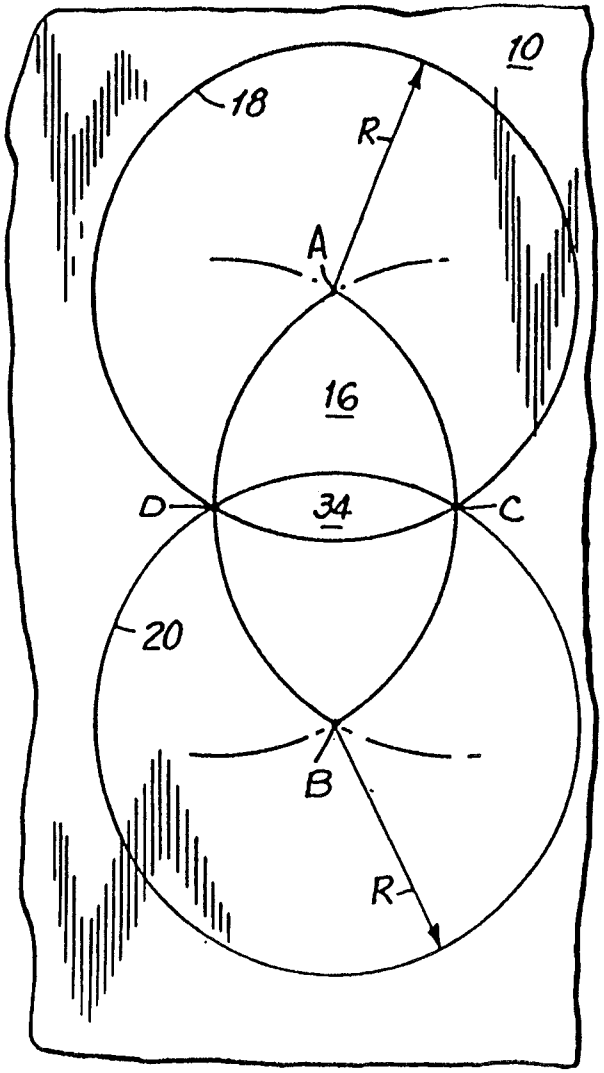
FIG. 2 is an illustration of the common area of the intersecting circles of FIG. 1 upon which is superimposed two additional intersecting circles.

Referring now to FIG. 2, there is illustrated two additional circles 18, 20 also of same radius R. These circles 18, 20 are inscribed in a manner such that they intersect each other as well as arcs AB of the common area 16 at points C and D respectively. In this manner, arcs CD of circles 18 and 20 define a second common area 34 which later becomes one of the side portions or flaps of the three dimensional object according to the invention. It should be noted that in FIG. 1, the only arc portions of circles 12 and 14 that must be inscribed on the flat, flexible material 10 are arcs AB. Similarly, in FIG. 2, the only arc portions to be inscribed are arcs CD from each circle 18 and 20.

Figure 3:
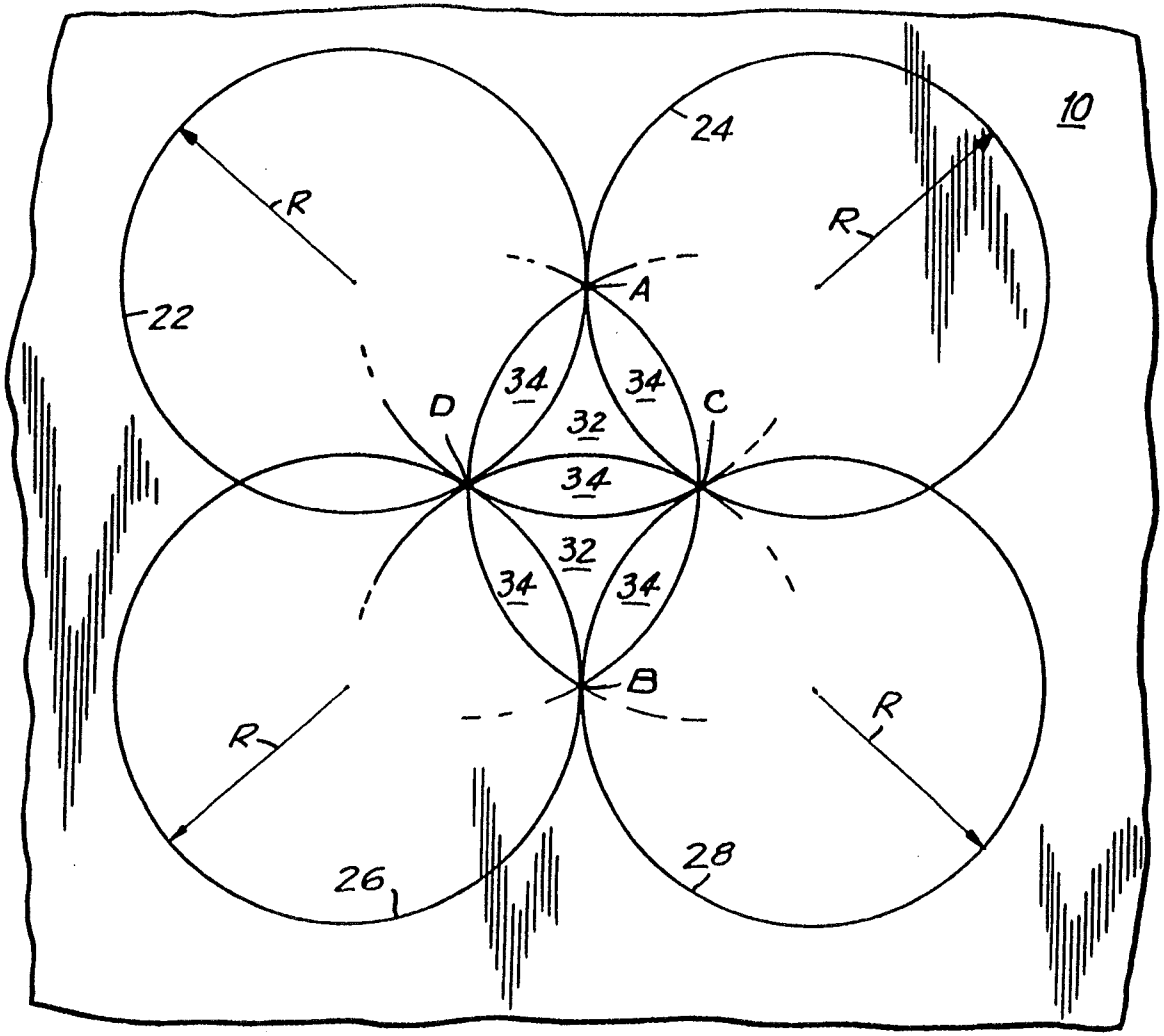
FIG. 3 is an illustration of four additional circles superimposed upon the common area of the intersecting circles of FIGS. 1 and 2.

Referring now to FIG. 3, four circles 22,.24, 26, 28 all having the same radius R are further inscribed on the flat, flexible material 10 in such a manner that each circle individually intersects only two of the four points indicated in FIG. 2. Specifically, circle 22 intersects points AD, circle 24 intersects points AC, circle 26 intersects points DB and circle 28 intersects points CB. These four new circles generate four new common areas 34 within the element and these in turn become four additional sides of the three dimensional object. Although evident from the drawing, it should be noted that each area 34 is identical in size and shape.

Figure 4:
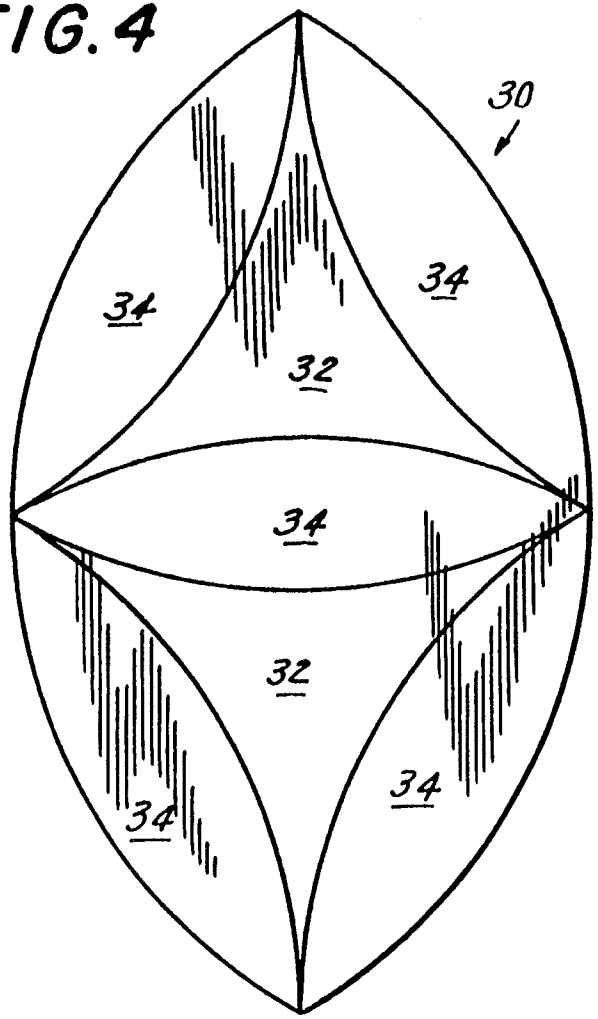
FIG. 4 is an illustration of an element according to the invention.

FIG. 4 shows the element 30 which is cut out from the flat, flexible material and includes two trigonal face components 32 and five oblong side components 34. As mentioned above, the element 30 is one basic building block for the three dimensional objects of the invention.

Figure 5:
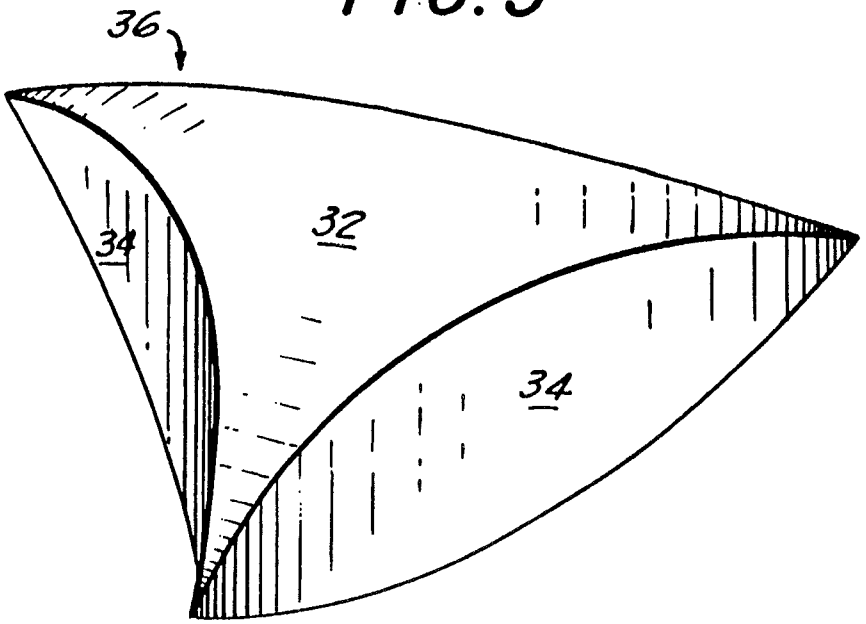
FIG. 5 is an illustration of a three dimensional object according to the invention.

Referring now to FIG. 5, element 30 in which each side portion 34 has now been folded to provide the illustrated three dimensional object 36.

Figure 6:
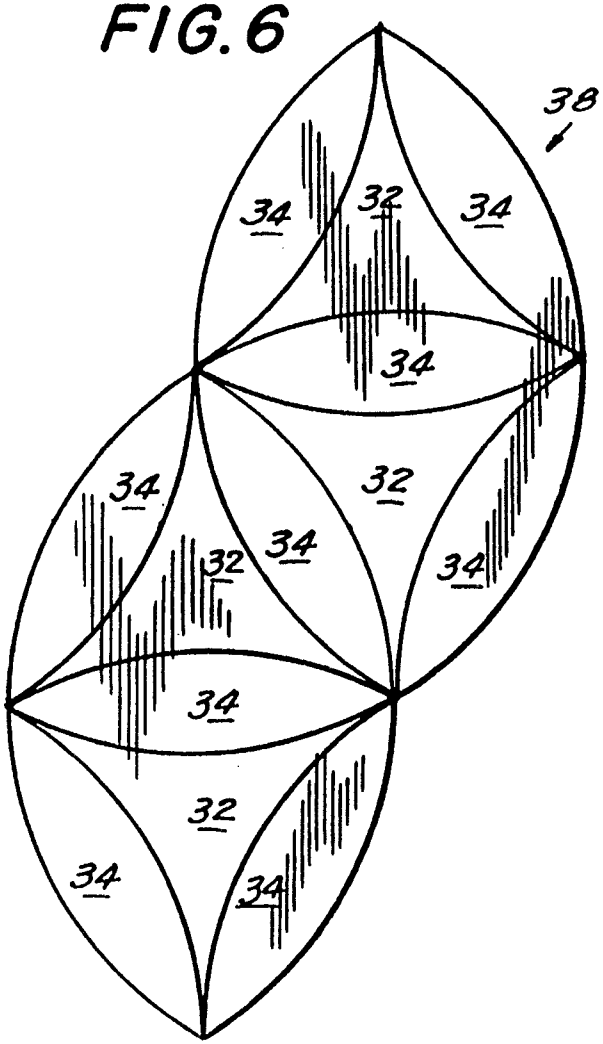
FIG. 6 is an illustration of another element according to the invention.

FIG. 6 shows a different element 38 which can be used for making other three dimensional objects according to the invention. As noted previously, the element in FIG. 6 can be made either by inscribing two individual elements as in FIG. 4 such that one is partially superimposed upon the other, or by preparing two separate elements according to FIG. 4 and joining one to another by partial superimposition.

Figure 7:
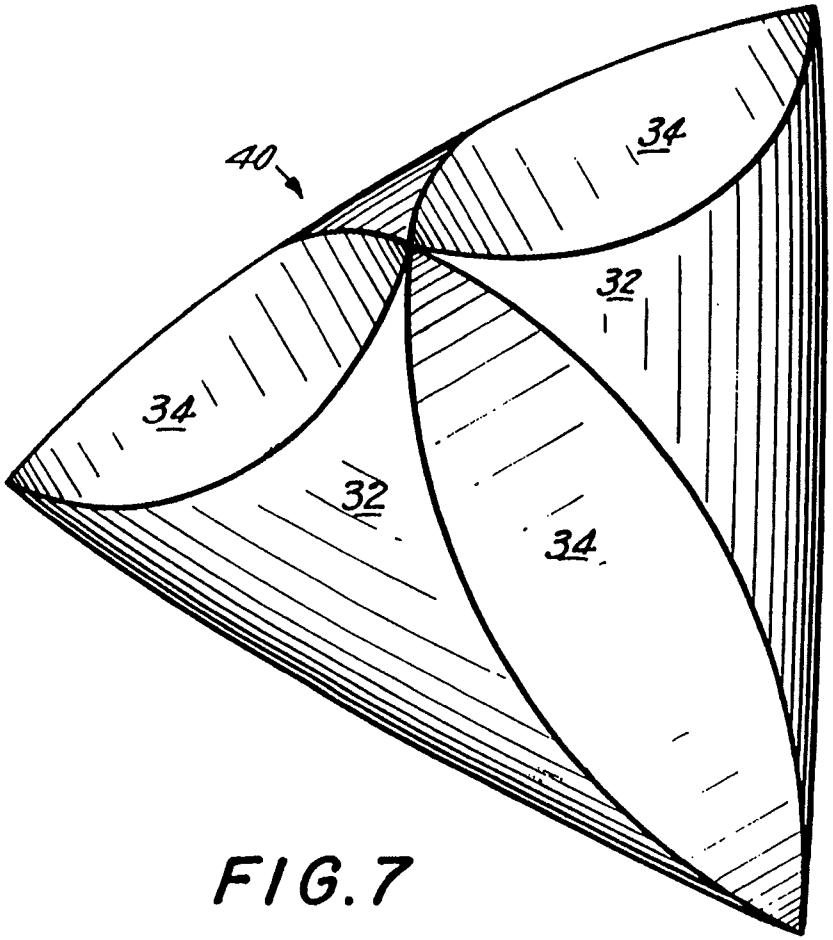
FIG. 7 is an illustration of another three dimensional object according to the invention.

FIG. 7 shows the three dimensional object 40 produced from the element of FIG. 6.

It should be noted that the three dimensional objects of FIGS. 5 and 7 can be made and will retain their shape due to the tension in the folded side portions 34, which are also known as tension flaps. The trigonal components 32 form the faces of the object.

It should also be noted that none of the trigonal faces 34 or tension flaps 32 are planar. The tension flaps 32 are oriented to provide inwardly curved arc portions, while the trigonal components 34 have a slight outward curvature or "bow".

Figure 8:
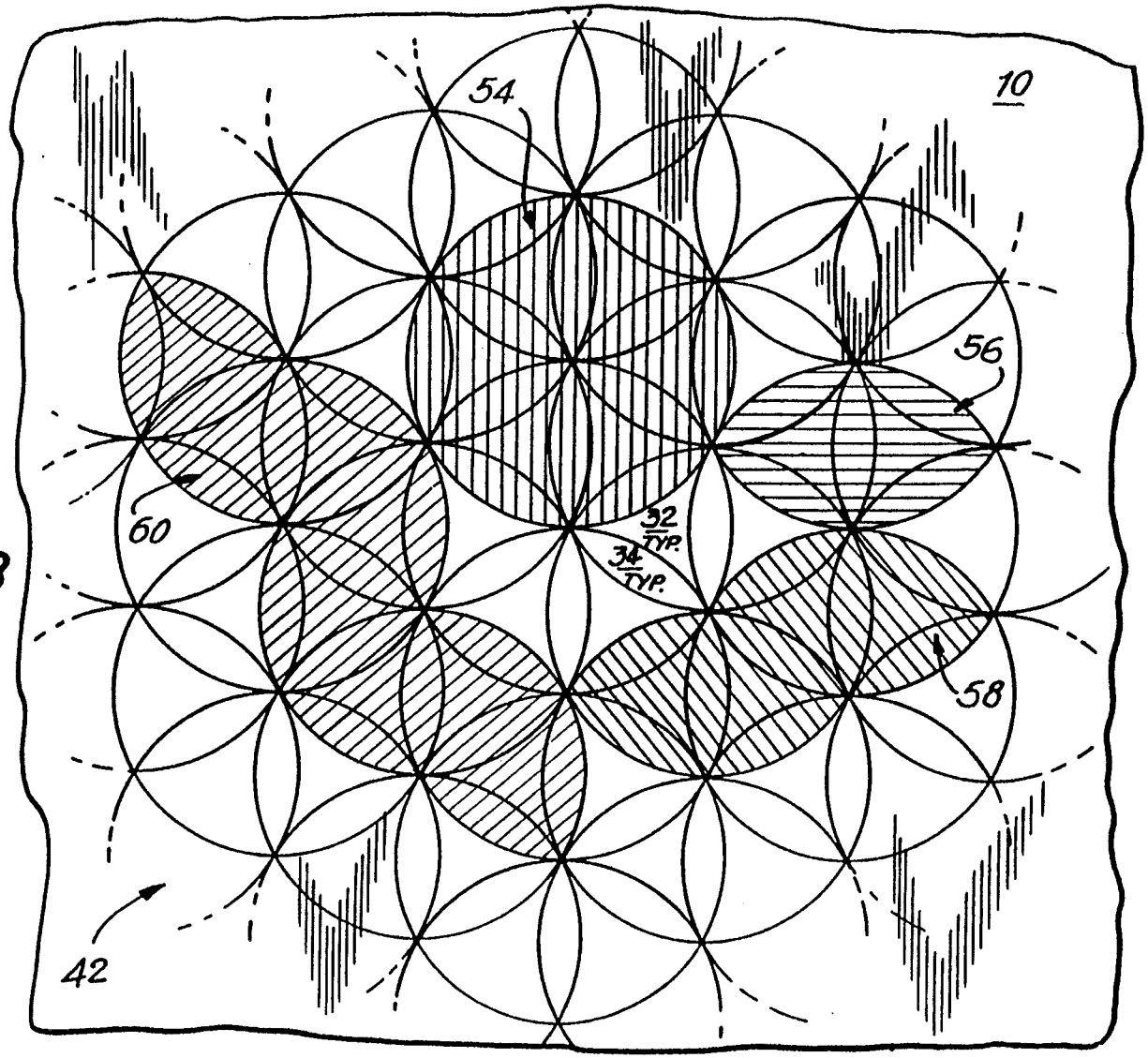
FIG. 8 is an illustration of superimposed intersecting circles which are useful for constructing larger elements.

Referring now to FIG. 8 there is illustrated a matrix generator 42, which is a pattern generated by continuing to superimpose circles as described hereinabove to form any desired number of trigonal faces 34 and tension flaps 32. One or any number of desirable elements can be formed from the matrix generator 42. Elements 54, 56, 58, 60 are shown in outline as non-limiting examples. Then, these desired elements can be cut out from the flat flexible material along the inscribed lines and then folded to form the desirable three dimensional objects.

Although an advantageous embodiment of the invention relates to three dimensional objects which are capable of being completely closed, it may be desirable to have open "faces", and such elements cut out of FIG. 8 which provide such open faces that may have particular utility as art objects, swimming pools, tanks, buildings, or other items requiring one or more openings in one or more sides.

It may also be desirable for certain applications involving large or multi-elemental combinations to fold only some of the tension flaps or side portions. In this embodiment, numerous variations of the completely folded three dimensional objects can be obtained, with or without the open faces described previously.

As an alternate way of constructing the elements of the present invention, polygons having equilateral side portions of length R can first be inscribed on the flat flexible material. Then, a first circle of radius R is superimposed on the polygon in a, manner such that the circle passes through the endpoints of each side of the polygon with the arc portion of the circle extending into the polygon. Then, a second circle of radius R is superimposed on the polygon in a similar manner as described above, except that the arc portion of the circle extends outside of the polygon.

Figure 9:
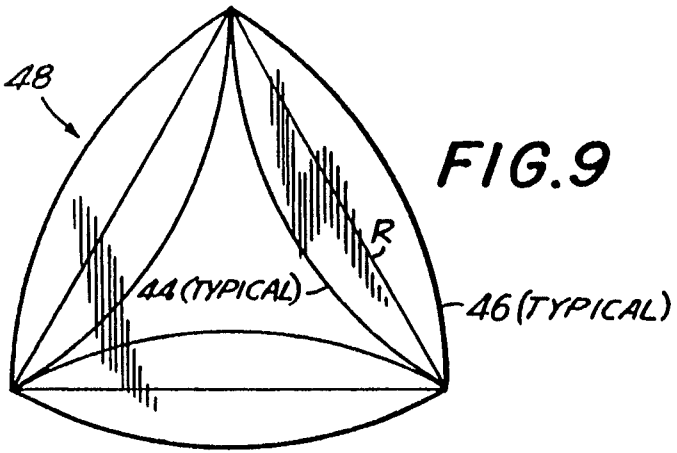
FIGS. 9, 10, and 11 are illustrations of additional elements of the invention.
Figure 11:
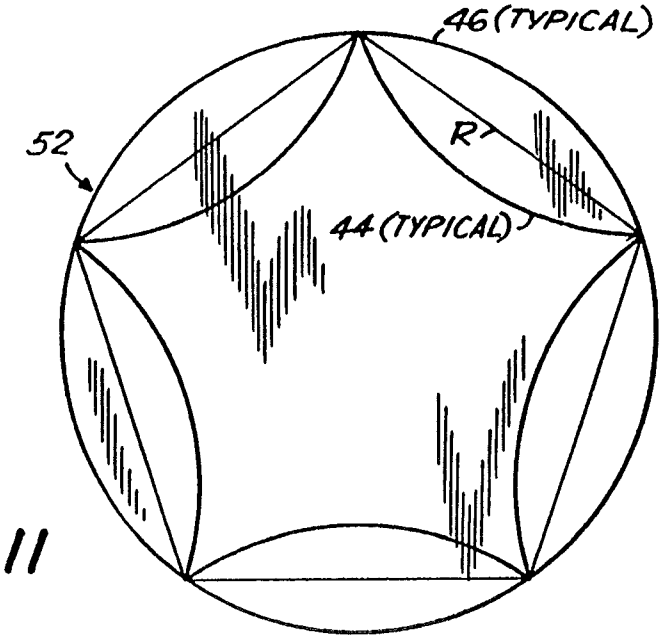
Figure 10:
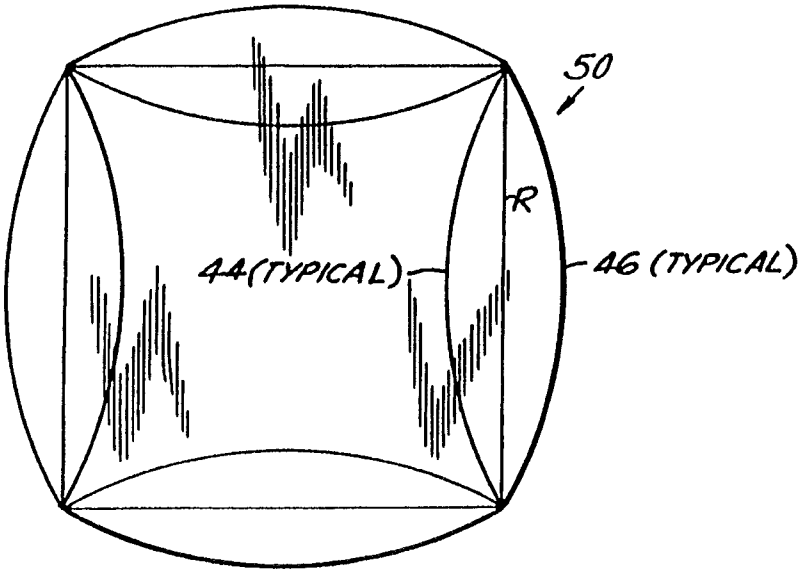

Specific elements made in accordance with this technique are illustrated in FIGS. 9, 10, and 11. The polygon originally constructed in each of those FIGS. are an equilateral triangle, a square, and an equilateral pentagon, each having sides of length R. After constructing the polygon, circles of radius R are superimposed upon the polygon as described above such that inner arc portions 44 and outer arc portions 46 are added to each side to form elements 48, 50, and 52 in FIGS. 9, 10 and 11, respectively.

Figure 12:
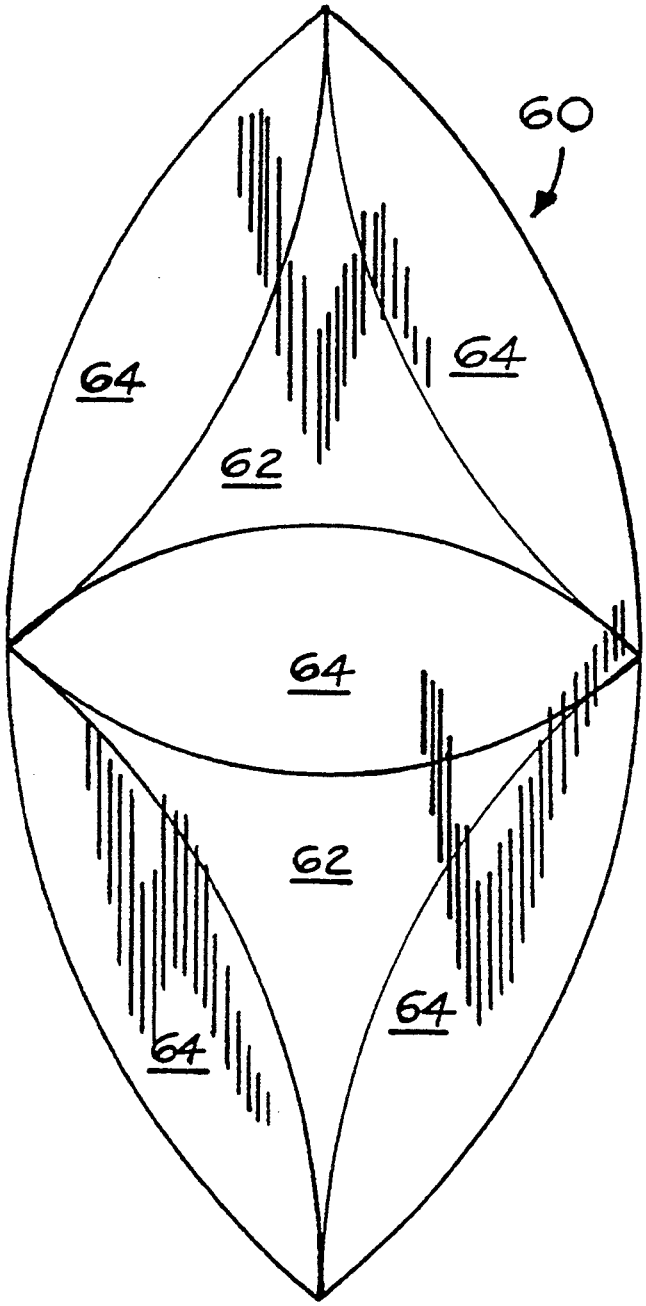
FIG. 12 is an illustration of an element formed from a pair of triangles each having one side of a length different from that of the other sides.

Another embodiment of the invention relates to the use of polygons which do not have equilateral sides. Thus, for example, isoceles triangles, rectangles, or trapezoids of four, six or other even numbered sides can be used to form further elements by inscribing inwardly and outwardly extending circles through each point where the sides connect. To provide the appropriate arc lengths, the inscribed circles should have the same diameter as the length of the side of the polygon where the arcs are to be inscribed. FIG. 12 illustrates an element 60 formed from a pair of isoceles triangles wherein the length of two legs are greater than the remaining leg. By inscribing circles as described above, the element 60 contains two elongated trigonal face components 62 and five side components 64.

The elements can then be joined to form complex elements by superimposing the particular individual elements upon a portion of an adjacent element, such as by superimposition of two tension flaps. To do this at least one side of the two polygons forming the elements to be superimposed must be the same length. Alternately, the elements can be prepared by first inscribing adjacent multiple (i.e., two or more) polygons, where each polygon shares a common side of the same length with an adjacent polygon.

Although numerous combinations are possible, those polygons having a degree of symmetry, such as isoceles triangles, rectangles, hexagons, octagons and decagons having two or three pair of equal length sides, and the like are preferred. The possible combinations of elements and three dimensional objects are only limited by the imagination of the user when following the teachings of the present invention.

Figure 13:
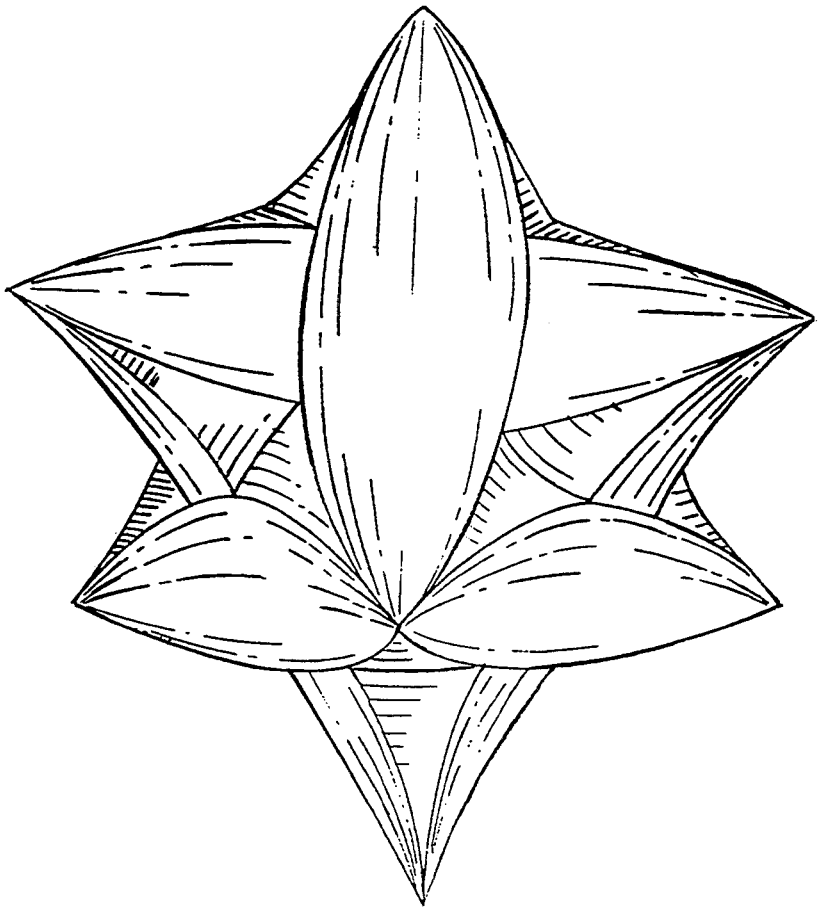
FIG. 13 is an illustration of a three dimensional object formed by combining two elements of FIG. 7 wherein the corners of an object formed from one element having an opening on each face portion is superimposed over the object formed from the other element.

Another embodiment of the invention relates to the superposition of a plurality of these three dimensional objects. Openings or apertures can be provided in one or more side or face components of an element, prior to forming the three dimensional object of that element about, around or upon a second three dimensional object formed from an element of the invention. One example of this is shown in FIG. 13 whereby a blank such as that of FIG. 6 having appropriate cut out areas in each face portion is assembled around the three dimensional object of FIG. 7. A wide variety of unusual shapes and configurations can be obtained through this aspect of the invention.

As would be evident, any desired polygon or number of polygons connected by at least one side with an adjacent polygon could be used to form an element, depending upon the desired size of the three dimensional objects. Also, it may be advantageous to construct a number of basic elements from polygons having a different number of sides. Then, these elements can be superimposed on each other in any desired manner, since each side having length R with inner arc portion 44 and outer arc portion 46 would be identical in size.

As would be understandable to one skilled in the art having the benefit of this disclosure before them, a wide variety of elements may be prepared, depending upon the final desired shape of the three dimensional object. Also, as mentioned above, when the object is to be constructed of materials that can not be bent, formed or otherwise shaped to the desired configuration, the object is then made by cutting out the individual components and then joining them together by an adhesive or other joining means.

It may also be possible to form final three dimensional products by molding, casting or other fabrication processes. In addition, tubular, rod, or strip sections can be bent to define the shapes of the desired three dimensional object. Mechanical connectors can then be used for making larger configurations. These sections can then be covered with a membrane or similar flexible material to obtain the object.

From the preceding it is apparent that a unique variety of three dimensional forms have utility as ornaments, containers, architectural analogues, equipment housings, lighting fixtures, furniture items, toys and games, construction elements, art objects, packaging and merchandising exhibits, stackable modules as well as many other applications, too numerous to list here. Depending upon the desired use these objects may be made either in a solid or hollow form.

The above described processes and elements are preferably utilized in a hollow form for the manufacture of cardboard boxes or containers having at least two trigonal components with sides and edges comprised of inwardly curved arc portions.

Also, it is well known that the hollow three dimensional objects can be provided with apertures, windows, or other openings for gaining entrance into or access to the three dimensional object. For example, if the three dimensional object is used as a beverage container, it would preferably include an opening having a removable cap for introduction and withdrawal of fluid contents thereinto and therefrom.

Similarly, when used as a packaging item, such as a cardboard box, for example, the three dimensional object of FIG. 7 could be designed such that it can be opened so that the contents can be removed therefrom.

Alternately, when used as solid three dimensional objects, the invention has utility as art objects, building blocks, toys, or the like.

While it is apparent that the invention herein disclosed fulfills the objects above stated, it will be appreciated that numerous modifications and embodiments may be devised by those skilled in the art, and it is intended that the appended claims cover all such modifications and embodiments as fall within the true spirit and scope of the present invention.

I claim:

1. A method for making an element capable of forming a three dimensional object, which comprises:

a) inscribing a first set of two circles, having the same radius, on a flat flexible material, said circles intersecting at a first point A and a second point B and producing a common area therebetween; such that the width of the common area along a straight line from point A to point B equals the length of the radius of the circles;

b) inscribing a second set of two intersecting circles, each of the same radius as the circles in step a) in a manner such that they each intersect the circles of step a) and each other at a common first point C and a common second point D, midway along each arc AB which defines the common area of the intersecting circles of step (a);

c) inscribing an additional four circles each having the same radius as the circles in step a) in a manner such that an arc of a first circle intersects points A and C; an arc of a second circle intersects points C and B; an arc of a third circle intersects points A and D; and an arc of a fourth circle intersects points D and B; said arcs of each of said four additional circles extending into the common area of the circles of step a); thus forming two trigonal face components, one by the inwardly extending arcs between points A and C, C and D, and D and A, respectively, and one by the inwardly extending arcs between points C and D, D and B, and B and C, respectively, and five side components by the area between the inwardly and outwardly extending arcs between points A and C, C and D, D and A, D and B, and B and C, respectively; and d) separating the inscribed portion of said flat, flexible material along a perimeter formed by the outermost arcs of the inscribed circles which perimeter completely surrounds each of the trigonal face and side components to obtain an element having at least two trigonal face components and at least five side components, which element is capable of forming a three dimensional object by folding said element along the arcs thereof.

2. The method of claim 1 which further comprises making a complex element by inscribing additional circles by repeating steps (a), (b) and (c) in such a manner to form at least two additional trigonal face components and at least three additional side components by the arcs of the inscribed circles so as to form an element having at least four trigonal face components wherein the trigonal face components are adjacent each other and each two adjacent face components are separated by one side component.

3. A method for forming a three dimensional object which comprises:

a) making the element according to claim 1; and b) bending or folding the element along at least some of the arcs to form the three dimensional object.

4. The method of claim 3 which further comprises:

c) making a second element with openings in at least two face portions; and d) bending or folding the second element around said first element so that a portion of the sides of the object formed from the first element extends through the openings of the face portions of the second element to form the three dimensional object.

5. The method of claim 1 which further comprises making a complex element by repeating steps (a), (b) and (c) as often as desired to form a number of additional face and side components.

6. A method for forming a three dimensional object which comprises:

a) making the element according to claim 5; and b) bending or folding the element along at least some of the arcs to form the three dimensional object.

7. The method of claim 6 which further comprises:

a) making a second element with openings in at least two face portions; and b) bending or folding the second element around said first element so that a portion of the sides of the object formed from the first element extends through the openings of the face portions of the second element to form the three dimensional object.

8. The method of claim 1 which further comprises preparing a matrix generator by repeating steps (a), (b) and (c) as often as necessary to form the desired number of face and side components; outlining the perimeter of a complex element and separating the element from the matrix generator along the outlined perimeter.

9. A method for forming a three dimensional object which comprises:

a) making the element according to claim 8; and b) bending or folding the element along at least some of the arcs to form the three dimensional object.

10. The method of claim 9 which further comprises:

a) making a second element with openings in at least two face portions; and b) bending or folding the second element around said first element so that a portion of the sides of the object formed from the first element extends through the openings of the face portions of the second element to form the three dimensional object.

* * * * *